US008826466B1

(12) United States Patent
Michaelis

(10) Patent No.: US 8,826,466 B1
(45) Date of Patent: Sep. 9, 2014

(54) ENHANCED ACCESS GARMENT

(71) Applicant: Chad Alan Michaelis, Aledo, TX (US)

(72) Inventor: Chad Alan Michaelis, Aledo, TX (US)

( * ) Notice: Subject to any disclaimer, the term of this patent is extended or adjusted under 35 U.S.C. 154(b) by 0 days.

(21) Appl. No.: 14/186,211

(22) Filed: Feb. 21, 2014

Related U.S. Application Data

(60) Provisional application No. 61/769,862, filed on Feb. 27, 2013.

(51) Int. Cl.
*A41D 13/00* (2006.01)
*A41D 15/00* (2006.01)

(52) U.S. Cl.
CPC ..... *A41D 15/002* (2013.01)
USPC ..... 2/69

(58) Field of Classification Search
USPC ..... 2/69, 93, 94, 102, 105, 15, 74, 462, 2/467, 86, 92
See application file for complete search history.

(56) References Cited

U.S. PATENT DOCUMENTS 4,370,757 A 2/1983 Richmond
4,383,335 A 5/1983 Slocum
4,651,346 A 3/1987 Hale
4,683,594 A 8/1987 Feinberg
4,853,977 A 8/1989 Foreman
4,864,657 A 9/1989 Lake
5,084,914 A 2/1992 Hesch
D325,459 S 4/1992 Keever
5,367,710 A 11/1994 Karmin
5,572,742 A 11/1996 McFadden
5,799,330 A 9/1998 O'Donoghue-Kitt
5,911,312 A 6/1999 Holyfield
6,907,619 B2 * 6/2005 Gathings, Jr. ..... 2/97
D563,079 S 3/2008 McPeek
7,653,949 B2 2/2010 Kraus et al.
7,930,769 B2 * 4/2011 Stern ..... 2/243.1
8,161,573 B1 4/2012 Burns-Cox

* cited by examiner

*Primary Examiner* — Tejash Patel
(74) *Attorney, Agent, or Firm* — Anderson & Levine, L.L.P.

(57) ABSTRACT

A robe-like garment with a liftable back panel. A draw string internal to the robe drapes over either the left or right shoulder of the wearer, and is attached to the bottom of the rear panel. To lift the rear panel, the wearer pulls downward on the draw cord. The panel then lifts to expose the back of the wearer, for example to allow the wearer to use a toilet. The panel may be constructed as multiple folding panels, like an accordion, or simply gathered in a vertical manner.

15 Claims, 8 Drawing Sheets

ENHANCED ACCESS GARMENT

CROSS-REFERENCE TO RELATED APPLICATIONS

This application claims priority, under 35 U.S.C. §119(e), of Provisional Application No. 61/769,862, filed Feb. 27, 2013 incorporated herein by this reference.

STATEMENT REGARDING FEDERALLY SPONSORED RESEARCH OR DEVELOPMENT

Not applicable.

BACKGROUND OF THE INVENTION

This invention is in the field of garments. More specifically, embodiments of this invention are directed to full-length garments, such as robes, gowns, and the like.

Long garments, such as extending below the mid-thigh of the wearer, are worn for various reasons. Certainly long garments may be worn for reasons of comfort, style, personal preference, or for certain events (e.g., formal events) or situations (e.g., inclement weather). Often, long garments are necessary or desirable for persons that are chronically ill, recuperating from an illness or surgery, or housed in a nursing home or other geriatric facility.

Regardless of the reason for wearing the garment, while the length of the garment is convenient and desirable for much of the time, that length can sometimes cause discomfort or difficulty, for example as the wearer uses the toilet or otherwise sits, undergoes a medical examination, or engages in various activities such as riding astride a motorcycle or horse. Depending on the situation, these longer-length garment may more easily become soiled, particularly in rearranging the longer portion to accommodate the change in position or usage. For these situations, the wearer is faced with the choice between not wearing a longer length garment at all, or suffering the discomfort or trouble of rearranging the garment.

BRIEF SUMMARY OF THE INVENTION

Embodiments of this invention provide a longer length garment that provides improved comfort, range of motion, and reduced risk of soiling.

Embodiments of this invention provide such a garment that remains attractive and modest as worn.

Embodiments of this invention provide such a garment that provides the wearer with additional flexibility of activity while wearing the garment.

Other objects and advantages of embodiments of this invention will be apparent to those of ordinary skill in the art having reference to the following specification together with its drawings.

This invention may be implemented into a garment of a length extending to a length beyond the seat area of the wearer, and which has a liftable rear panel attached to the rear of the garment, at a location ranging from the neckline to the mid- to upper back, depending primarily on the material and how it bunches when raised. When not raised, the rear panel extends over and covers an opening in the back of the garment. A lifting member such as one or more drawstrings is attached to the rear panel at or near its bottom edge, and is attached within the garment to extend over the shoulder of the wearer. By pulling the lifting member (either manually or by way of a motor) the wearer can raise the rear panel, for example above the seat area. Enhanced access to the exposed rear of the wearer is then provided, facilitating toilet use and other temporary activities of the wearer.

DETAILED DESCRIPTION OF THE INVENTION

This invention will be described in connection with certain of its embodiments, namely as implemented into a robe-like garment, as it is contemplated that the invention is particularly beneficial in that application. However, it is further contemplated that this invention will provide important advantages and benefits when applied to other garments and uses, such as coats, raincoats, riding wear, and the like. Accordingly, it is to be understood that the following description is provided by way of example only, and is not intended to limit the true scope of this invention as claimed.

Figure 1:
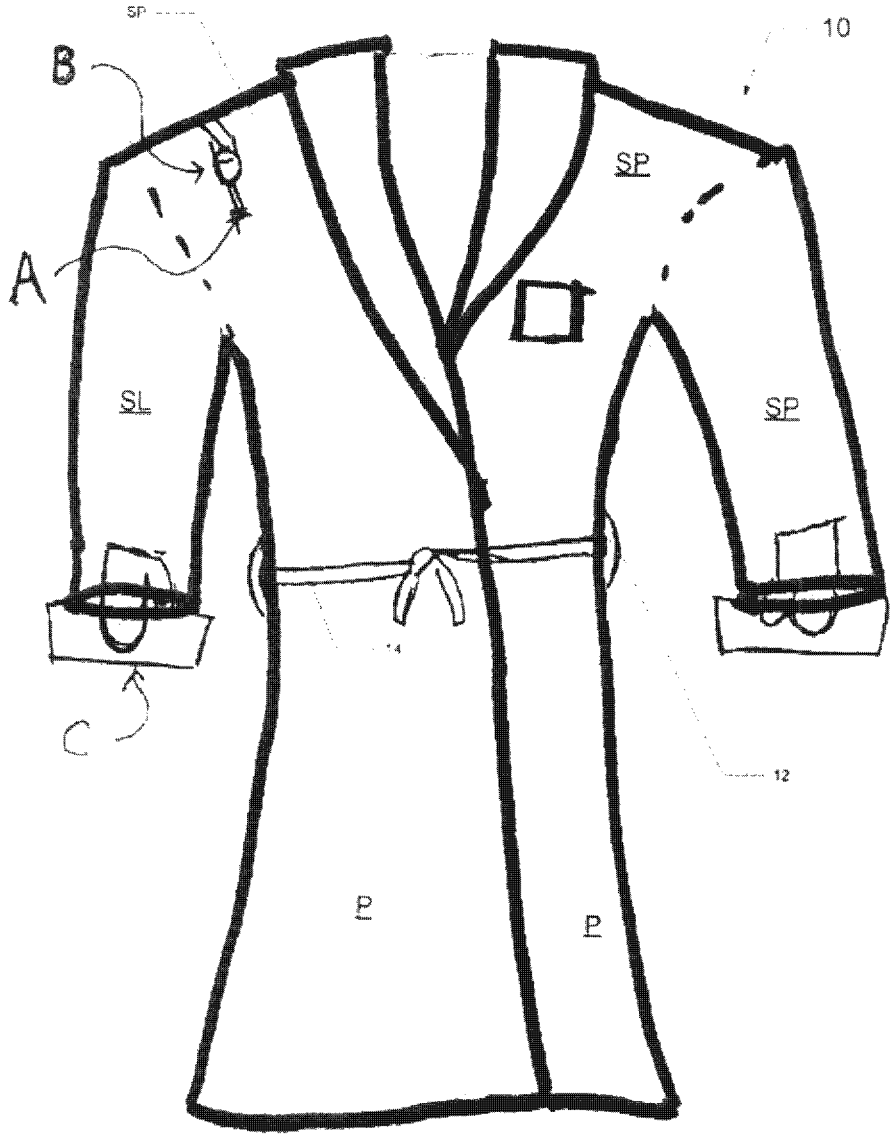
FIG. 1 is an elevation view from the front of a garment constructed according to an embodiment of the invention.

FIG. 1 is a front view of garment 10, in the form of a robe, in an example of this embodiment of the invention. As evident from FIG. 1, garment 10 is constructed of conventional material for bathrobes and housecoats, and is of a conventional full length. In this example, belt loops 12, through which belt 14 runs, are located at a middle location of the garment (i.e., intended to be near the waist of the wearer). Garment 10 includes left and right front panels P, defining an opening at the front should belt 14 be untied; other closures such as buttons, a zipper, snaps, and the like may alternatively be used to close the edges of panels P. Front panels P are unitary with shoulder portions SP, each of which extend to the back of garment 10; sleeves SL are attached to shoulder portions SP in this embodiment of the invention, but may be omitted if a sleeveless gown is desired. Alternatively, shoulder portions SP may be separate pieces of fabric sewn to front panels P at the appropriate locations, depending on the construction of garment 10.

In a more general sense, the vertical (i.e., from the shoulder downward) length of garment 10 according to embodiments of this invention will extend substantially beyond the waist of the wearer, generally long enough to cover the seat area of the wearer, and in some cases extending to floor-length. Panels P wrap around the sides of the wearer to a short distance, but do not extend across the back of garment 10 as will be evident from this description. While garment 10 of FIG. 1 is in the form of a robe, it is contemplated that garment 10 may alternatively be a house coat or house dress; gown; coat, jacket, raincoat, or other outerwear garment; or the like.

Further in the alternative, garment 10 may be constructed to have a single front panel P, in which case garment 10 will be fully closed in the front at all times. Still further in the alternative, panel or panels P may each be constructed from multiple pieces of fabric sewn together. For example, each panel P may be constructed in two pieces, sewn together along a seam running from under the armhole (i.e., at which the sleeve is attached) downward to its bottom hem. It is contemplated that the number of individual pieces of fabric used to form the various portions of garment 10 may vary according to the desired construction.

Figure 2:
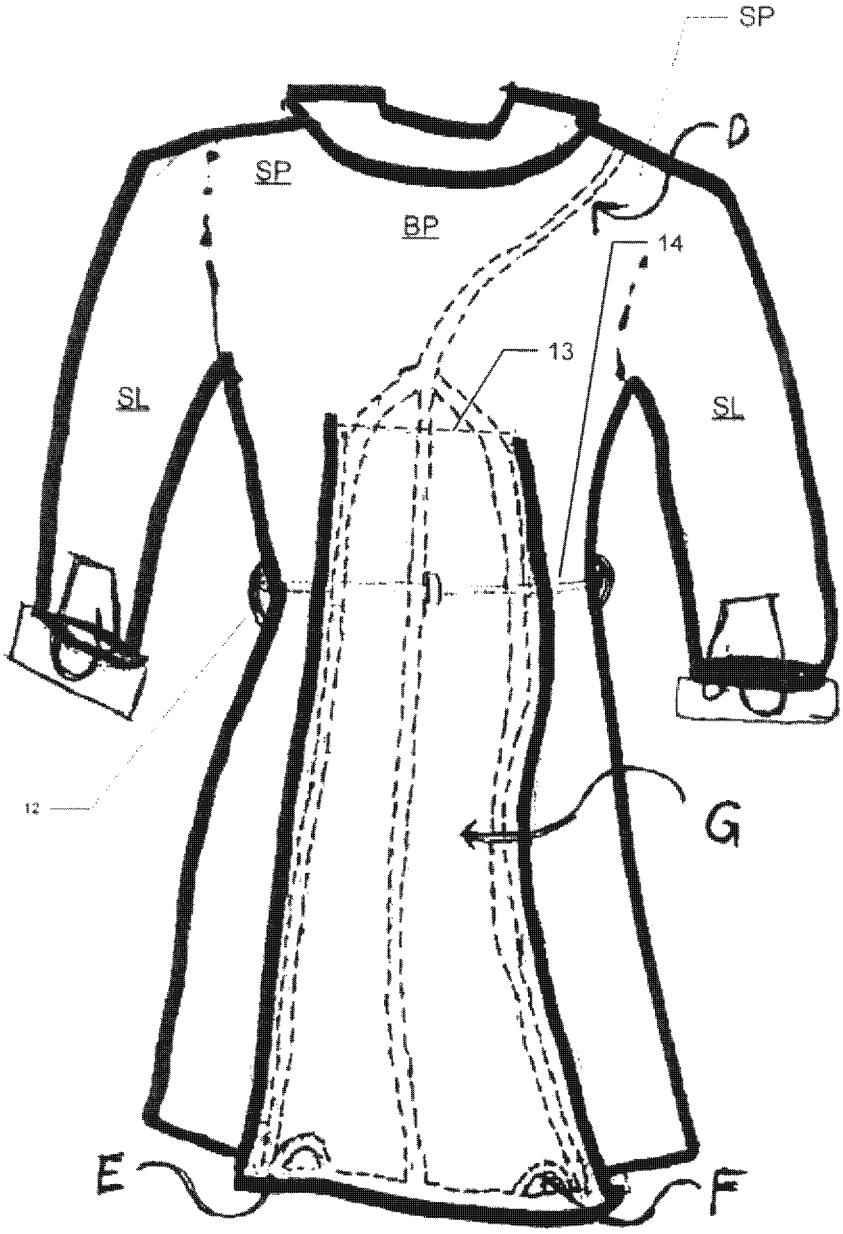
FIG. 2 is an elevation view from the rear of a garment constructed according to an embodiment of the invention.

FIG. 2 illustrates garment 10 from the rear. According to this embodiment of the invention, garment 10 includes a liftable rear panel G attached at its top to the mid-to-upper back portion BP of the garment 10 between shoulder portions SP. Rear panel G is attached to back portion BP at location 13 above the waist location of garment 10 (as indicated by the location of belt loops 12), in this example. In its lowered position, as shown in FIG. 2, rear panel G hangs downwardly to cover a rear opening (not visible) between panels P of garment 10.

In the example of FIG. 2, belt loops 12 are located below location 13 at which rear panel G is attached to back portion BP. As such, belt 14 passes either over (as shown in FIG. 2) or beneath rear panel G in this example. It is contemplated that, in many implementations, it may be useful to position belt loops 12 above location 13 at which rear panel G attaches to back portion BP, so that belt 14 does not interfere with the raising and lowering of rear panel G; this may, in some implementations, result in belt loops 12 and belt 14 being positioned above the waist of the wearer. Alternatively, belt 14 may be a "faux" belt, constructed in two pieces, each affixed to back portion BP at a location below location 13 at which rear panel G attaches, so as not to interfere with the raising and lowering of rear panel G. Further in the alternative, garment 10 may be constructed without either belt 14 or belt loops 12.

It is contemplated that the height of location 13 may vary among specific implementations of garment 10. In general, it is contemplated that location 13 may range from near the neckline of garment 10 to the mid- to upper back of garment 10, depending on the particular construction of garment 10 and the manner in which rear panel G "bunches" when raised. For example, if the material of rear panel G is relatively thin or light, so as to gather tightly when raised, location 13 may be closer to the mid-back or waist of garment 10 while still allowing the seat regions of the wearer to be exposed as necessary to accomplish the particular task desired. If the material of rear panel G is thicker, or constructed to fold in an accordion-like manner (as discussed below), location 13 should be placed some distance above the mid-back or waist region of garment 10 in order to expose the necessary regions of the wearer when rear panel G is raised. If rear panel G is constructed to fold in very large panels when raised, it may be necessary for location 13 to be placed as high as near the neckline of garment 10 to accomplish the necessary exposure. It is contemplated that those skilled in the art having reference to this specification will be readily able to place location 13 in the appropriate location for the particular construction of an implementation of garment 10, without undue experimentation.

In the example of FIG. 2, perimeter weights E are attached to the lower hem of rear panel G to maintain it in place when lowered; alternatively, the weight of rear panel G itself (e.g., if constructed of multiple panels), elastic or magnetic devices, or other mechanisms or construction may be incorporated into rear panel G to maintain its proper position when lowered. In this embodiment of the invention, optional heel/toe hooks F are provided inside and at the bottom of rear panel G, and are constructed in the form of loops of fabric, cord, or the like. Hooks F enable the wearer to use his heel or toes to fully pull down rear panel G during its lowering, in case gravity is insufficient to reposition it properly, saving the wearer from bending over to accomplish this.

If desired, rear panel G may be constructed to have a removable inside liner (not shown), which may be removed as needed for washing without requiring laundering of the entirety of garment 10. It is contemplated that such a removable inside liner may be attached by hook-and-loop fasteners, buttons, snaps, a zipper, or another conventional attachment system.

According to embodiments of this invention, rear panel G of garment 10 is liftable from the bottom, when desired by the wearer. As seen in shadow in the rear view of FIG. 2, drawstring D runs along the inside of or otherwise interiorly to garment 10 (i.e., drawstring D is not exteriorly visible) from over the shoulder and running to the bottom edge of panel G, at or near which it is attached. As shown in FIG. 1, drawstring D extends over (or under) shoulder portion SP of garment 10, terminating at the front of garment 10 at drawstring end A. By pulling on drawstring end A, drawstring D will raise the bottom edge of rear panel G to a height desired by the wearer (e.g., to accomplish the particular task or change in position). If desired, locking mechanism B, in the form of a clasp or other lock, is provided to retain drawstring D, so as to retain rear panel G in a raised position without requiring the wearer to continue pulling. This clasp or lock may be located on garment 10 at any one of a number of places of convenience to the wearer. In this example, FIG. 2 illustrates that drawstring D splits into multiple branches, three such branches in this case, to assist the even raising of panel G; of course, a single drawstring branch or a pair of drawstring branches may instead be used. Additional drawstrings may also be added, to accommodate the size, shape, or other differences in the construction of garment 10.

Various alternative approaches to implementing drawstring D are contemplated. Drawstring D itself may be implemented as a single string, cord, or strap, a system of multiple strings, cords or straps, or of other construction suitable for raising rear panel G. In the embodiment of FIGS. 1 and 2, drawstring end A provides an actuator, by way of which the wearer actuates the raising and lowering of rear panel G simply by pulling end A downwardly or forwardly (or both), which pulls drawstring D and raises rear panel G from its bottom edge. By extending drawstring D over the shoulder of the wearer, the shoulder provides a fulcrum for this lifting motion, converting forward or downward pull of drawstring end A into a lifting force. The wearer may maintain rear panel G in the desired position by continuing to pull the actuator of drawstring end A, or by way of locking mechanism B, if implemented. Actuation of the raising of rear panel G may be implemented by alternative mechanisms, such as a motor and the necessary linkage of the motor to drawstring D, in the alternative to the manual actuation (i.e., the pulling of end A) shown in FIGS. 1 and 2.

Figure 3:
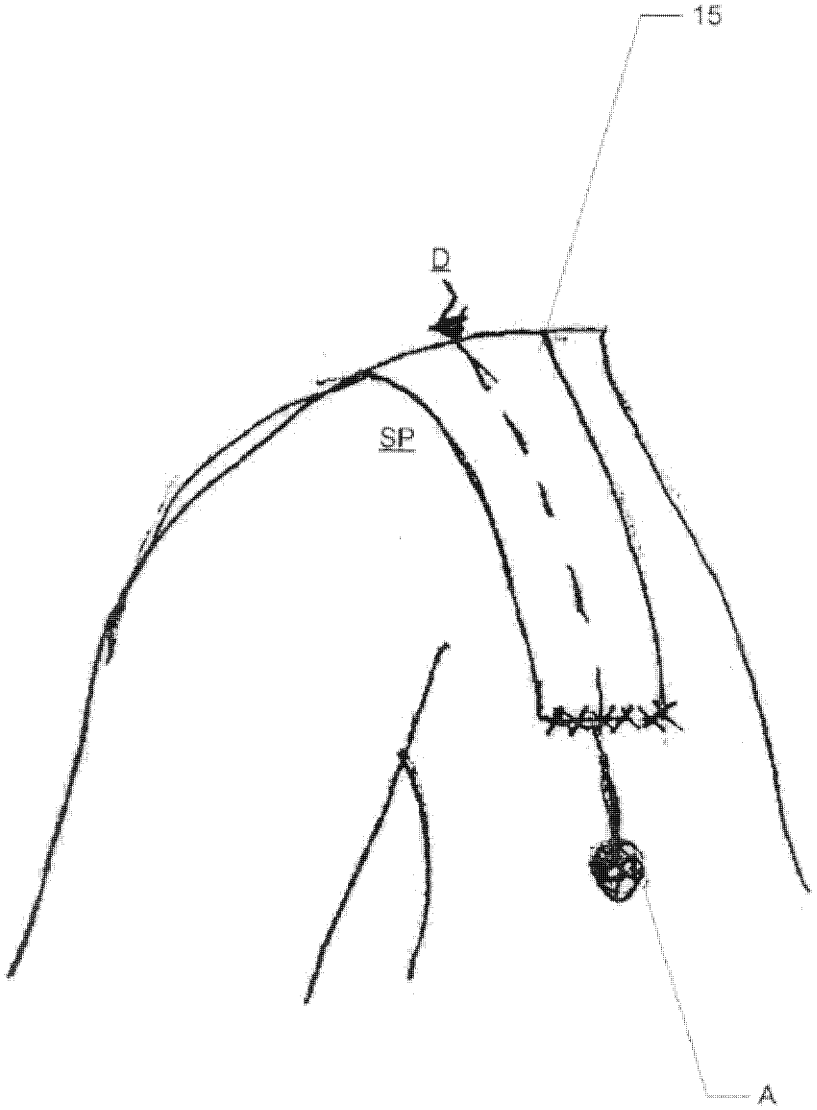
FIG. 3 is an elevation view of a portion of the front of the garment, illustrating its draw cord according to another embodiment of the invention.

FIG. 3 illustrates, in additional detail, the implementation of drawstring D according to an embodiment of the invention. In this implementation, drawstring D passes between the surface or lining of garment 10 and fabric sleeve 15; fabric sleeve 15 thus retains drawstring D in an over-the-shoulder position. Fabric sleeve 15 may either be sewn on the exterior of shoulder portion SP, or alternatively on its inner lining or surface. If sewn on its inner lining, drawstring end A may pass through a slit through the front panel of garment 10 so as to be easily pulled or otherwise actuated; alternatively, drawstring end A may be retained within garment 10, requiring the wearer to reach under garment 10, for example with his off-side hand, to actuate rear panel G.

Figure 4A:
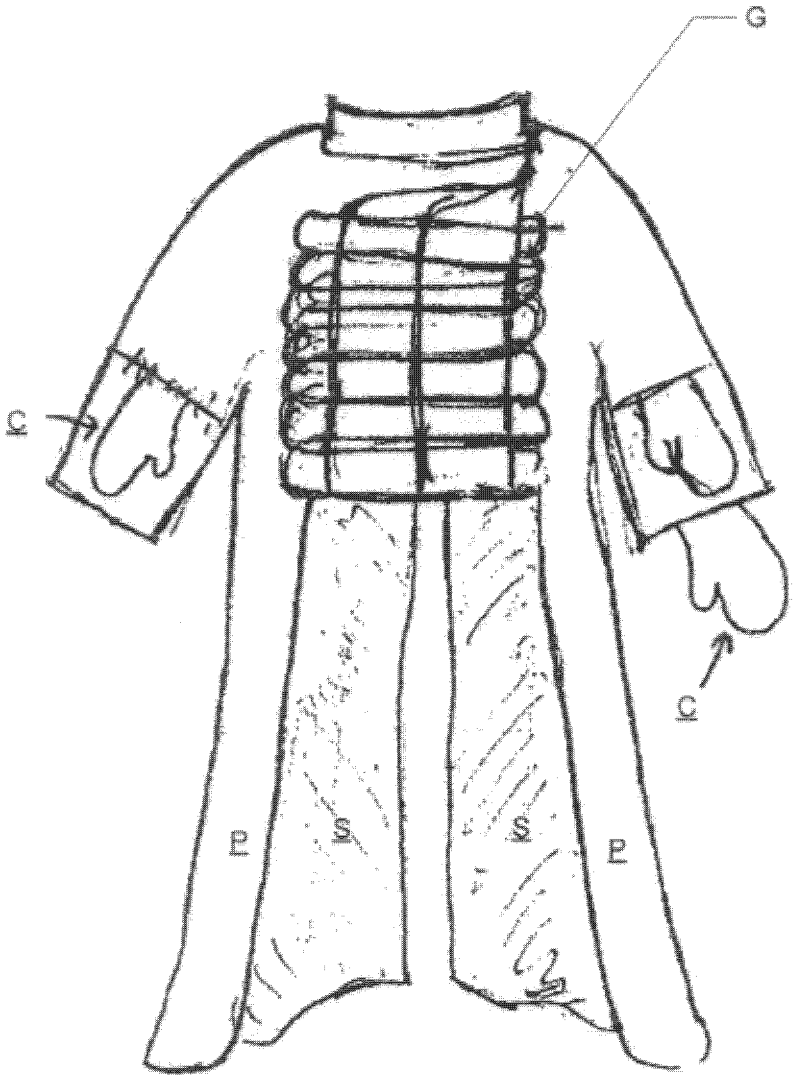
FIGS. 4*a* and 4*b* are elevation views from the rear and side of the garment of FIGS. 1 and 2, with the rear panel of the garment raised.
Figure 4B:
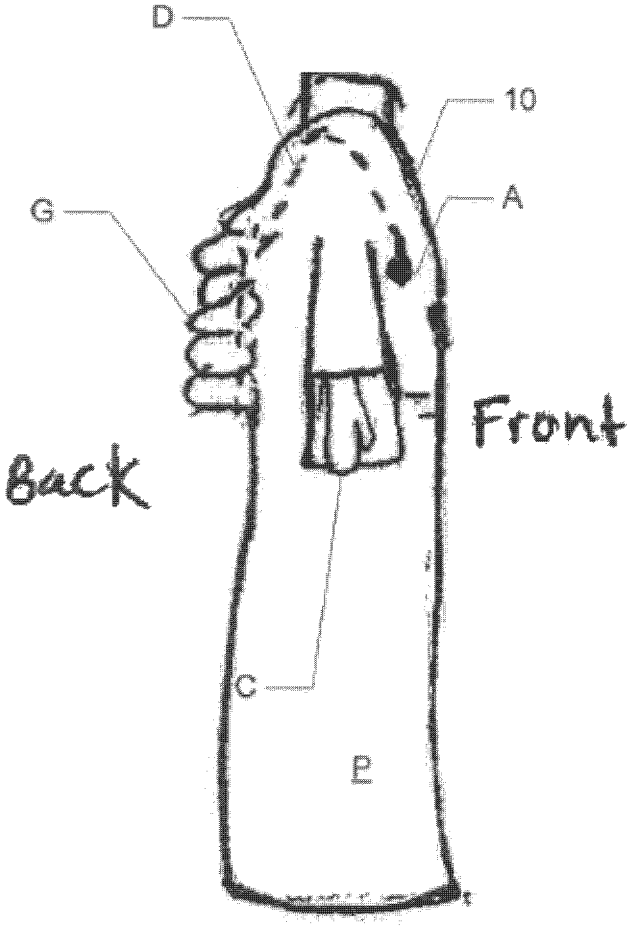

FIGS. 4*a* and 4*b* illustrate garment 10 in its state with rear panel G raised by drawstring end A having been pulled forward and downward from the top of the shoulder, which in turn pulled drawstring D and thus raised up the bottom edge of rear panel G. In this embodiment of the invention, rear panel G is constructed as multiple individual panels that, when raised, fold upon each other in accordion fashion, as visible in the side view of FIG. 4*b*. Alternatively, rear panel G may be constructed from the appropriate fabric so as to simply gather vertically when raised. As evident in FIG. 4*a*, with rear panel G in its raised, folded, position, inner surfaces S of the front of garment 10 are visible from the back (no wearer being in the view of FIGS. 4*a* and 4*b*, of course).

Further in the alternative to locking mechanism B, other approaches to maintaining rear panel G in its raised position (FIGS. 4*a* and 4*b*) may alternatively be used. These alternatives include other types of locking mechanisms B, such as clips, clasps, cams, buttons, snaps, magnets, hook-and-loop fasteners, a loop through which drawstring end A with the appropriate cross-piece can be inserted, a loop to which drawstring A may be tied, and the like, each of which serve to hold drawstring end A in its forward and downward position. Further in the alternative, or additionally, a retention mechanism (not shown) may be implemented on rear panel G to hold it in place when raised, including one or more buckles, clips, clasps, looped fasteners, tie strings, buttons, snaps, magnets, friction between or within rear panel G, and the like.

Figure 4C:
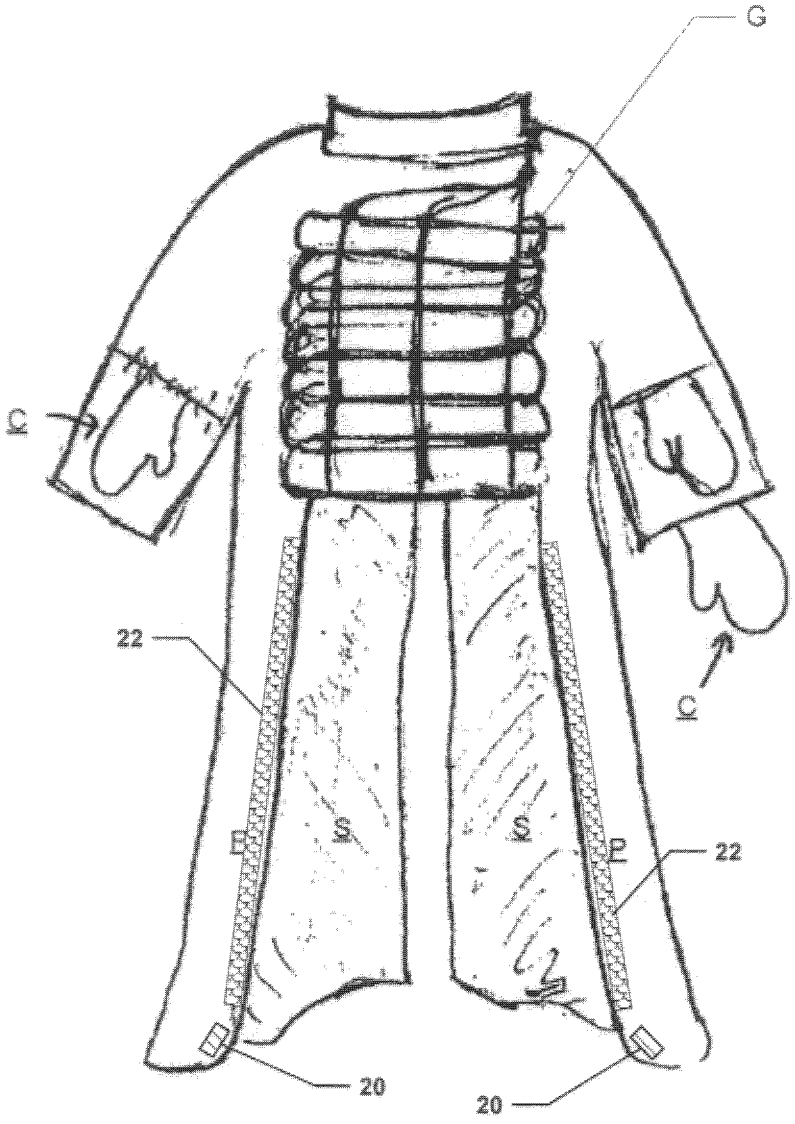
FIGS. 4*c* through 4*e* are elevation views from the rear of the garment of FIGS. 1 and 2, according to other embodiments of the invention.

FIG. 4*c* illustrates garment 10 incorporating optional features in the construction of panels P, according to an alternative construction. One of these optional features is shown in FIG. 4*c* as perimeter weights 20 sewn into or onto the bottom corners of panels P, at the rear opening of garment 10. Perimeter weights 20 will help to maintain panels P in position, without riding up, during and after the raising of rear panel G. Another optional feature shown in FIG. 4*e* is provided by strips 22 of interface material along the edges of panel P adjacent the rear opening of garment 10. As known in the art, "interface material", also known in the art as "interfacing material" or "interfacing", refers to a textile material having a stiffness and weight that can be sewn or fused to the "back" (i.e., unseen) side of the material of a garment to add firmness, shape, structure, and support, for example as in collars, cuffs, waistbands, pockets, shoulder seams, and necklines. In the embodiment of the invention shown in FIG. 4*e*, strips 22 of interface material are applied to the edges of panels P of garment 10, for example on the underside, to inhibit the grouping or bunching of panels P as rear panel G is raised. It is contemplated that the need for either or both of perimeter weights 20 and interface material strips 22 will generally depend on the particular material of garment 10 being used. Lightweight and rough-textured materials will be more susceptible to the grouping or bunching of panels P; conversely, heavier and smoother materials will be less susceptible to this effect, and may not require either or both perimeter weights 20 or interface material strips 22. It is contemplated that those skilled in the art having reference to this specification will be readily able to determine the desirability for, and the specific implementation of, either or both of perimeter weights 20 and strips 22, without undue experimentation.

Figure 4D:
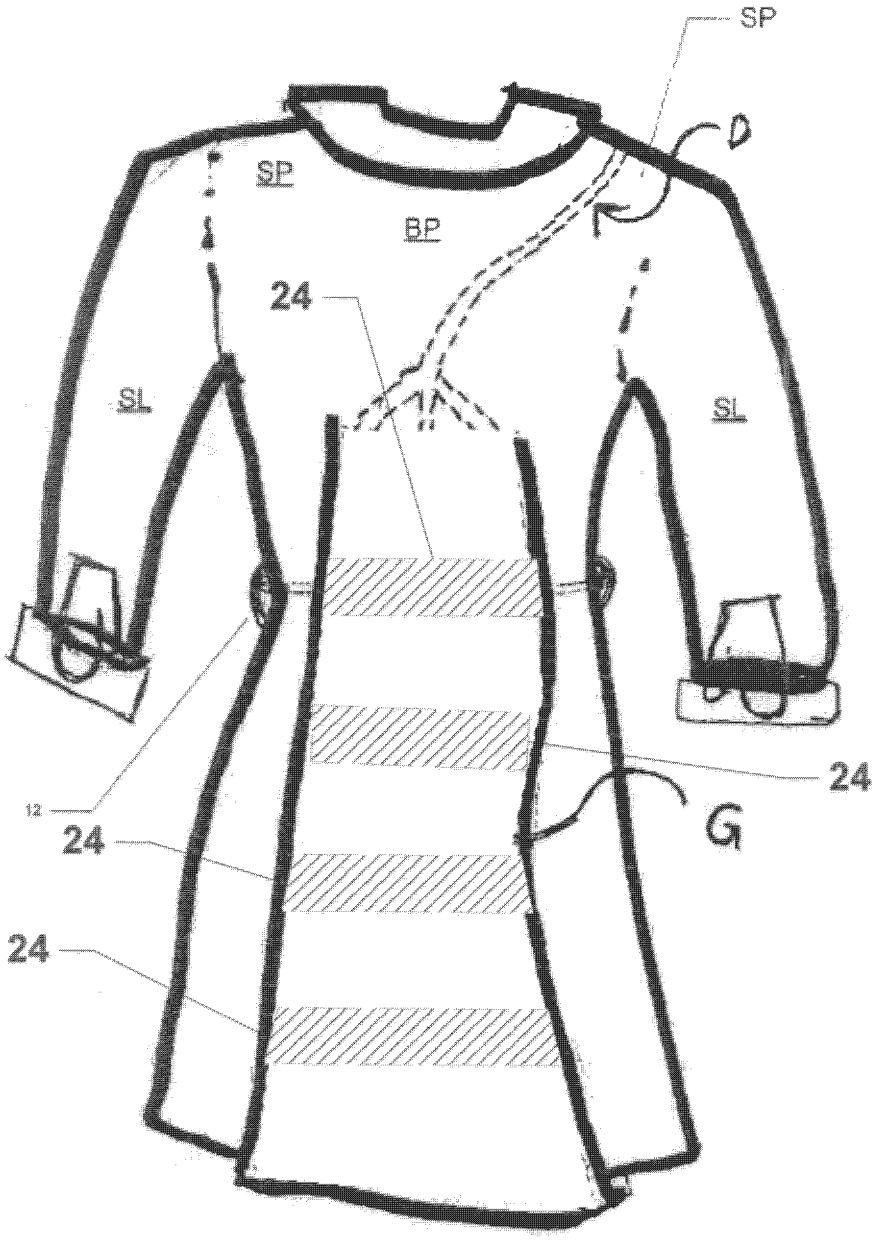
Figure 4E:
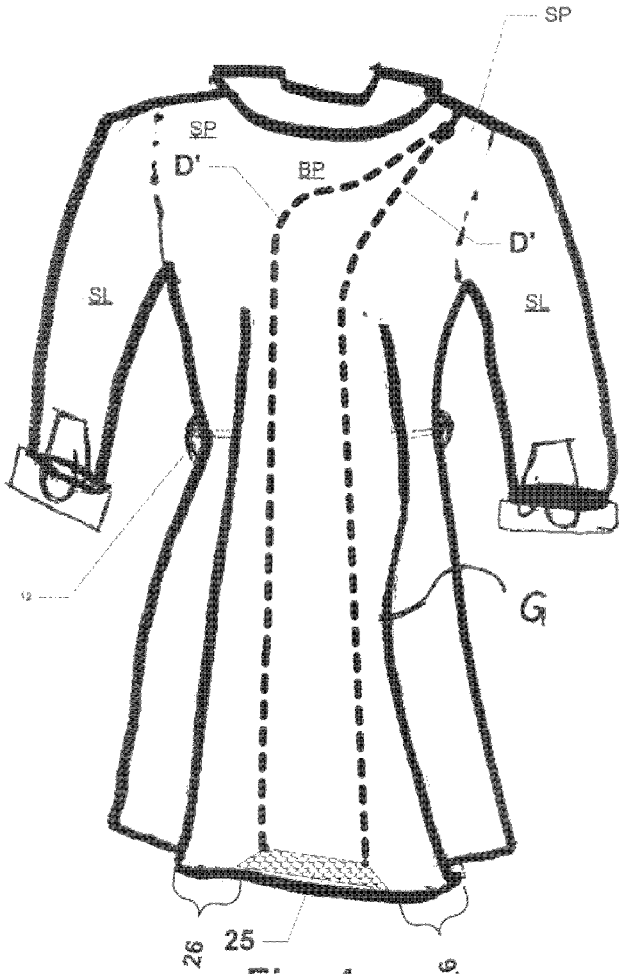

FIG. 4*d* illustrates garment 10 according to another embodiment of the invention; the lower branches of drawstring D are not shown for clarity of this drawing. In this embodiment, rear panel G is constructed to fold upon itself, in accordion fashion, when raised, for example as shown in the side view of FIG. 4*b*. In the implementation of FIG. 4*d*, strips 24 of interface material are sewn or fused onto rear panel G, typically on its underside so as not to be visible, to stiffen those portions of rear panel G. The number, width, and spacing of strips 24 may be selected according to the desired number and widths of the folds of rear panel G when raised.

FIG. 4*e* illustrates garment 10 according to another embodiment of the invention. In this view, rear panel G is shown in its lowered position, with drawstring D' shown in shadow as extending from shoulder portion SP to the bottom edge of rear panel G along its undersurface, or within the material of rear panel G. In this example, drawstring D' is implemented to have two branches extending from a point at the top of the shoulder at which the two branches are joined to a single drawstring portion (not shown) on the front of garment 10. In one implementation of this embodiment of the invention, the two branches of drawstring D' are implemented in the form of cables of fabric, plastic, or another material. It is believed, based on observation, that this implementation of drawstring D' as two branches of cable presents very low sliding resistance in the raising and lowering operations, as compared with other implementations.

Also according to the implementation of FIG. 4*e*, the two branches of drawstring D' attach to stiffener 25 that is sewn or fused at the bottom edge of rear panel G, typically on its back side (i.e., underside) so as not to be visible in normal wear. Stiffener 25 may be constructed of interface material as described above, of a weight and stiffness selected to facilitate the smooth raising of the bottom edge of rear panel G as drawstrings D' are pulled upward by the wearer. Stiffener 25 inhibits the bunching and scalloping of the material of rear panel G when raised, as may occur with the raising of the bottom edge only from the two points at which the branches of drawstring D' are attached. In this embodiment of the invention, it is contemplated that the interface material forming stiffener 25 will typically be relatively stiff, and may be preformed to have a curvature so as to lend the desired shape to garment 10 with rear panel G in its lowered position.

As shown in FIG. 4*e*, stiffener 25 need not extend the full width of rear panel G, but rather regions 26 of the bottom edge of rear panel G may extend on either side of stiffener 25. This allows the material of rear panel G to droop on either side of stiffener 25 as it is raised, reducing the weight of rear panel G. In this implementation, it is desirable that the width of stiffener 25 be selected so that this drooping of the sides of rear panel G does not interfere with the task for which it is being raised.

Other accessories may be incorporated into garment 10. FIGS. 1, 2, and 4*a* through 4*e* illustrate hand covers, in the form of mittens C (but which alternatively may be gloves), secured within the sleeves of garment 10. Snaps or buttons may hold mittens C within the sleeves when not in use; a tether or cord passing through the sleeves of garment 10 may be used to keep mittens C with garment 10 without risk of loss. Accessories may also include a hood, electric heating, pre-heatable hand warmers (e.g., for garment 10 used as a stadium robe), solar heating devices, ventilation slotting or flaps, pockets, removable liners or inserts, leg tie straps or cords, and the like.

As mentioned above, while various embodiments of this invention have been described with reference to the example of garment 10, it is contemplated that a wide variety of garments may be constructed according to this invention to obtain one or more of its benefits. Examples of garments that may implement embodiments of this invention include robes, housecoats, stadium robes, outerwear coats, raincoats, riding wear, and a wide variety of other long garments.

While this invention has been described according to its embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

What is claimed is:

1. A garment, comprising:

a garment portion having at least one front panel, shoulder portions, and a back portion, the at least one front panel extending around sides of the garment to define a rear opening below the back portion, the at least one front panel having a length extending below a waist location;

a rear panel suspended at its top from the back portion, and having a length sufficient to cover the back opening when lowered; and a lifting element attached on a first end near a bottom edge of the rear panel, and extending upwardly past a shoulder portion to a second end at the front panel.

2. The garment of claim 1, further comprising:

an actuator at the second end of the lifting element for pulling the lifting element so as to raise the rear panel.

3. The garment of claim 2, wherein the actuator is motorized.

4. The garment of claim 1, further comprising:

a locking mechanism coupled to the lifting element for maintaining the rear panel in a raised position.

5. The garment of claim 1, wherein the lifting member comprises:

a front portion extending from its second end over the shoulder portion; and one or more branches extending from the front portion to an attachment location near the bottom edge of the rear panel.

6. The garment of claim 1, further comprising:

a removable liner attachable to the interior of the rear panel.

7. The garment of claim 1, further comprising:

perimeter weights attached near the bottom edge of the rear panel.

8. The garment of claim 1, further comprising:

loops attached to the inner surface at the bottom of the rear panel.

9. The garment of claim 1, further comprising:

hand covering secured within sleeves attached to the shoulder portions.

10. The garment of claim 1, further comprising:

a plurality of perimeter weights, each attached to each of the at least one front panel near its corner at the rear opening.

11. The garment of claim 1, further comprising:

a plurality of strips of interface material, each attached to an edge of the at least one front panel along the rear opening.

12. The garment of claim 1, further comprising:

a plurality of strips of interface material attached horizontally at spaced-apart locations of the rear panel.

13. The garment of claim 1, further comprising:

a stiffener attached near the bottom edge of the rear panel; and wherein the lifting element comprises:

a front portion extending from its second end over the shoulder portion; and first and second branches extending from the front portion to first and second ends of the stiffener.

14. The garment of claim 13, wherein the stiffener has a width less than a width of the rear panel near its bottom edge.

15. The garment of claim 1, wherein the at least one front panel comprises first and second front panels, extending from a front opening of the garment around sides of the garment to the rear opening, each of the first and second front panels unitary with a corresponding shoulder portion of the garment.

* * * * *